US006570600B2

(12) United States Patent
Aroneo et al.

(10) Patent No.: US 6,570,600 B2
(45) Date of Patent: May 27, 2003

(54) METHOD AND APPARATUS FOR DIRECT CYLINDER PRINTER

(75) Inventors: Stephen L. Aroneo, Franklin Lakes, NJ (US); Jon Rosenfeld, Medford, MA (US)

(73) Assignee: Impress Systems, Lincoln, MA (US)

( * ) Notice: Subject to any disclaimer, the term of this patent is extended or adjusted under 35 U.S.C. 154(b) by 0 days.

(21) Appl. No.: 09/765,988

(22) Filed: Jan. 19, 2001

(65) Prior Publication Data

US 2002/0097315 A1 Jul. 25, 2002

(51) Int. Cl.[7] ..... B41J 2/325
(52) U.S. Cl. ..... 347/171; 347/215; 101/38.1
(58) Field of Search ..... 347/171, 4, 2, 347/3, 197, 213, 198, 217, 215; 101/38.1, 40.1; 400/235, 235.1

(56) References Cited

U.S. PATENT DOCUMENTS

| | | | | |
|---|---|---|---|---|
| 3,828,355 A | 8/1974 | Wick et al. | ..... | 346/75 |
| 4,091,726 A | 5/1978 | Walker | ..... | 101/38 |
| 4,384,518 A | 5/1983 | Albin | ..... | 101/40 |
| 5,184,152 A | 2/1993 | French | ..... | 346/76 |
| 5,694,839 A | 12/1997 | Wohl et al. | ..... | 101/39 |
| 5,893,016 A | 4/1999 | Landa et al. | ..... | 399/297 |
| 6,005,595 A | 12/1999 | Vanwey | ..... | 347/171 |
| 6,158,341 A | 12/2000 | Holmberg | ..... | 101/170 |

FOREIGN PATENT DOCUMENTS

| | | | | |
|---|---|---|---|---|
| JP | 6-236715 | * | 8/1994 | ..... B41F/17/10 |

* cited by examiner

*Primary Examiner*—Huan Tran
(74) *Attorney, Agent, or Firm*—Cesari and McKenna, LLP

(57) ABSTRACT

A cylinder printing system and method for transferring an image onto the exterior surface of a generally cylindrical substrate using a digital print engine for selectively generating and printing an image from a thermal foil onto a rotating cylindrical substrate wherein the thermal foil and substrate are synchronously advanced with respect to the print engine during printing.

24 Claims, 7 Drawing Sheets

METHOD AND APPARATUS FOR DIRECT CYLINDER PRINTER

BACKGROUND OF THE INVENTION

1. Field of the Invention

The present invention relates to the personalization or decoration of generally cylindrical substrates, and more particularly, to the on-demand digital thermal printing and application of images thereto.

2. Background Information

The printing systems of interest print alphanumeric information, designs and or logos onto a variety of cylindrical objects, such as pens, pencils, cosmetic items, medical devices (e.g., syringe barrels), etc. Accordingly, these systems require that the curved exterior surface of the cylindrical object contact a printing mechanism at all points of printing.

In prior known systems, several methods are used to print on cylindrical substrates. These methods include silk screening, hot stamping and pad printing. Unfortunately, these printing methods require runs of several units to be economical since each of these techniques requires a dedicated printing tool such as a screen, die or cliche. The tools, which are unique to the particular information or design to be printed, add significant cost. In addition, the inks, dies and chemicals used with conventional processes are environmentally hazardous, which adds the additional cost of disposal.

Silk-screening for example involves the use of a stencil and inking apparatus. Typically, the cylindrical substrate is brought into rotational contact with the stencil while a squeegee or other device pushes ink through the opposite side of the stencil. While this method of printing produces an adequate image, each change in design requires a replacement stencil. Hot stamping cylindrical print systems produce high quality print by means of a curved heated die carrying a specified design. The heated die presses a pigmented or metalized foil against the outer surface of the cylindrical object such that print is formed on areas where the heated die contacts the foil. Any change in design similarly requires a replacement die.

It is therefore an object of the present invention to a method and system for producing and applying images to a generally cylindrical substrate that is adaptable for economically printing short runs of different images.

SUMMARY OF THE INVENTION

To accomplish the foregoing and other objects, features and advantages of the present invention we have provided a digitally-controlled thermal printing system that uses a digital print engine to generate and print selected images onto a cylindrical substrate using a thermal foil. Digital technology allows each applied image to be unique and printed on demand.

The invention includes a system and apparatus for rotationally supporting and advancing a cylindrical substrate and a supply of thermal foil in synchronous cooperation with a print strobe. In certain embodiments of the present invention the thermal foil is used to advance and rotate the cylindrical substrate being printed. In additional embodiments the thermal foil and substrate are synchronously independently advanced using a variety of advancement means.

The invention makes use of unique thermal foils designed for application by a digital print engine. Particularly, the thermal foils include a film carrier that resists distortion when subjected to the pressures and relatively high temperatures associated with the digital thermal printing process. More specifically, these thermal foils include a backcoating that comes into contact with the print head. The backcoating includes a lubricant that reduces the drag of a thermal print head, thus preventing the thermal foils from sticking to the thermal print head during printing.

The thermal foils used by the inventive system further include a top coat that resists distortion when subjected to the elevated temperatures (approaching 400 degrees F.) associated with the digital transfer process. The thermal foil preferably also includes a fast-acting yet aggressive thermally activated adhesive (size coat) that facilitates image transfer from the foil to a substrate.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
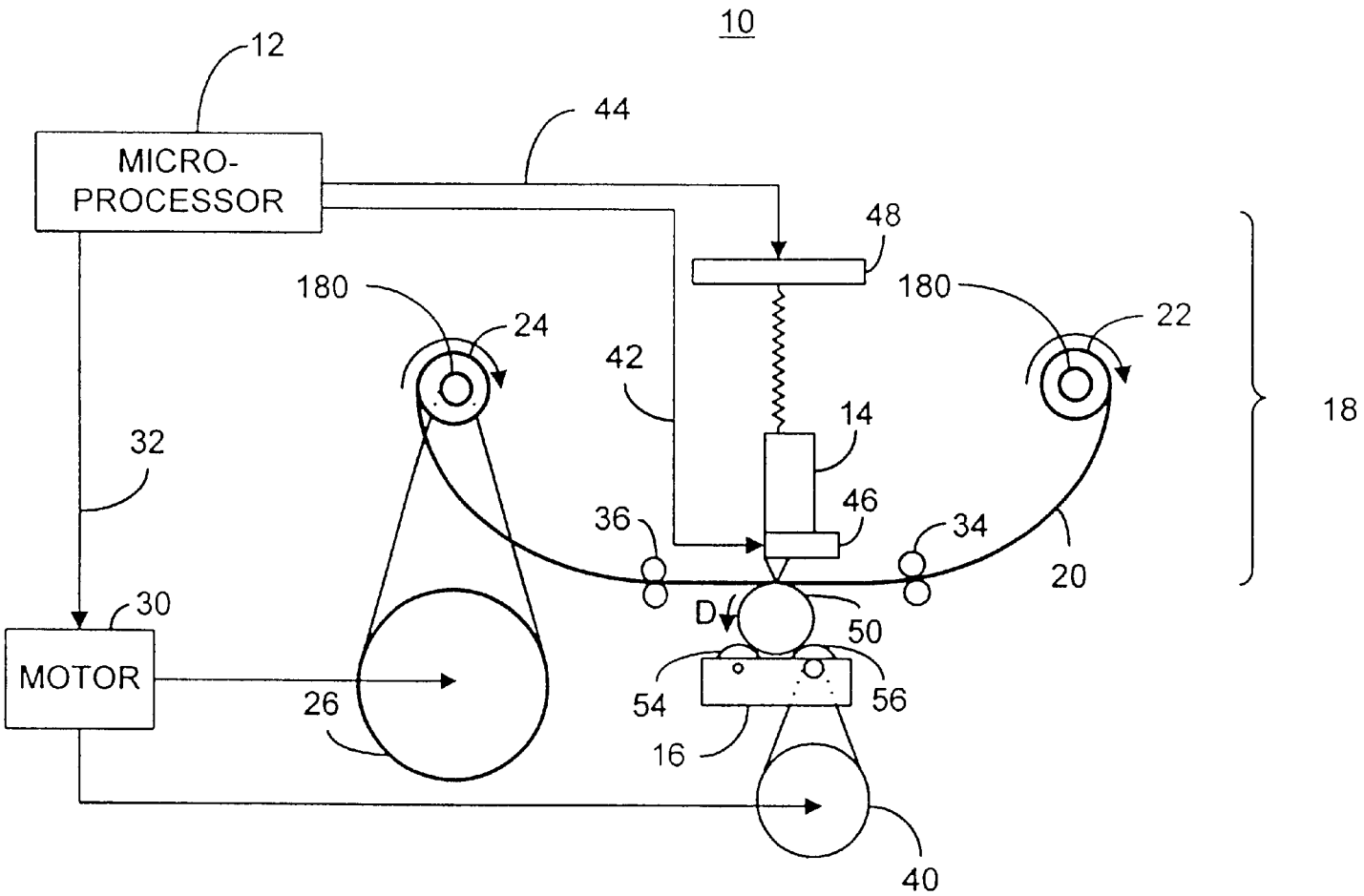
FIG. 1 depicts a partial diagrammatic side view of a cylinder print system in accordance with the invention.

Referring to FIG. 1, a cylinder print system 10 includes a microprocessor 12, a thermal print head assembly 14, a substrate bed assembly 16 and a thermal foil assembly 18 in accordance with the present invention. Microprocessor 12 controls the printing process and generates a selected shape to be printed.

Thermal foil assembly 18 includes a supply of thermal foil 20, which is supplied from a supply roll 22 and collected on a take-up roll 24. An advancing mechanism 26 is preferably driven by a motor 30 (e.g., a servomotor or stepper motor), which receives control signals on line 32 from microprocessor 12 and which precisely controls the advancement of thermal foil 20. The advancing mechanism 26 drives take-up roll 24 using a belt, gear or other similar means, which in turn advances thermal foil 20.

During the printing process, microprocessor 12 provides control signals on lines 42 and 44 that direct thermal print head assembly 14, which includes a thermal print head 46 and a pressure mechanism 48 (e.g., a pneumatic actuator), to apply both heat and pressure to thermal foil 20. The combination of heat and downward pressure cause portions of the foil 20 to detach and adhere to the cylindrical substrate 50. A pair of guide rods 34, 36 assist in keeping thermal foil 20 properly tensioned and aligned with print head is assembly 14 during foil advancement and printing. Guide rods 34, 36 further serve to create a constant media path and to reduce foil creasing and wrinkling. The operation of printing is discussed in more detail with reference to FIGS. 3–5 below.

In the present embodiment, substrate bed assembly 16 includes a pair of supporting rollers 54, 56. Preferably, supporting rollers 54, 56 are rubber coated to allow ade20 quate friction to drive cylindrical substrate 50 while allowing for some compression to straighten warped or otherwise non-perfectly cylindrical substrates to be printed. Bed assembly 16 further includes an optional advancing mechanism 40 for driving supporting roller 56, which in turn rotates cylindrical substrate 50 during the printing process. Various diameter substrates may be used by adjusting the gap between print head 46 and bed assembly 16. Substrate bed assembly 16 may further include adjustment means for repositioning substrate bed assembly 16 in a direction perpendicular to the path of thermal foil 20. This allows an image to be printed on different portions of a substrate 50.

In this embodiment, motor 30 is operatively connected to both advancing mechanism 40 and advancing mechanism 26 so that motor 30 may synchronously advance thermal foil 20 with the rotation of cylindrical substrate 40 during printing. A separate motor (not shown) controlled by microprocessor 12 may also be used to separately drive advancing mechanism 50. Advancing mechanism 40 is optional because cylinder print system 10 may employ a frictional force between thermal foil 20 and substrate 50 that is created as thermal foil is advanced past substrate 50, to synchronously advance thermal foil 20 with substrate 50.

Figure 2:
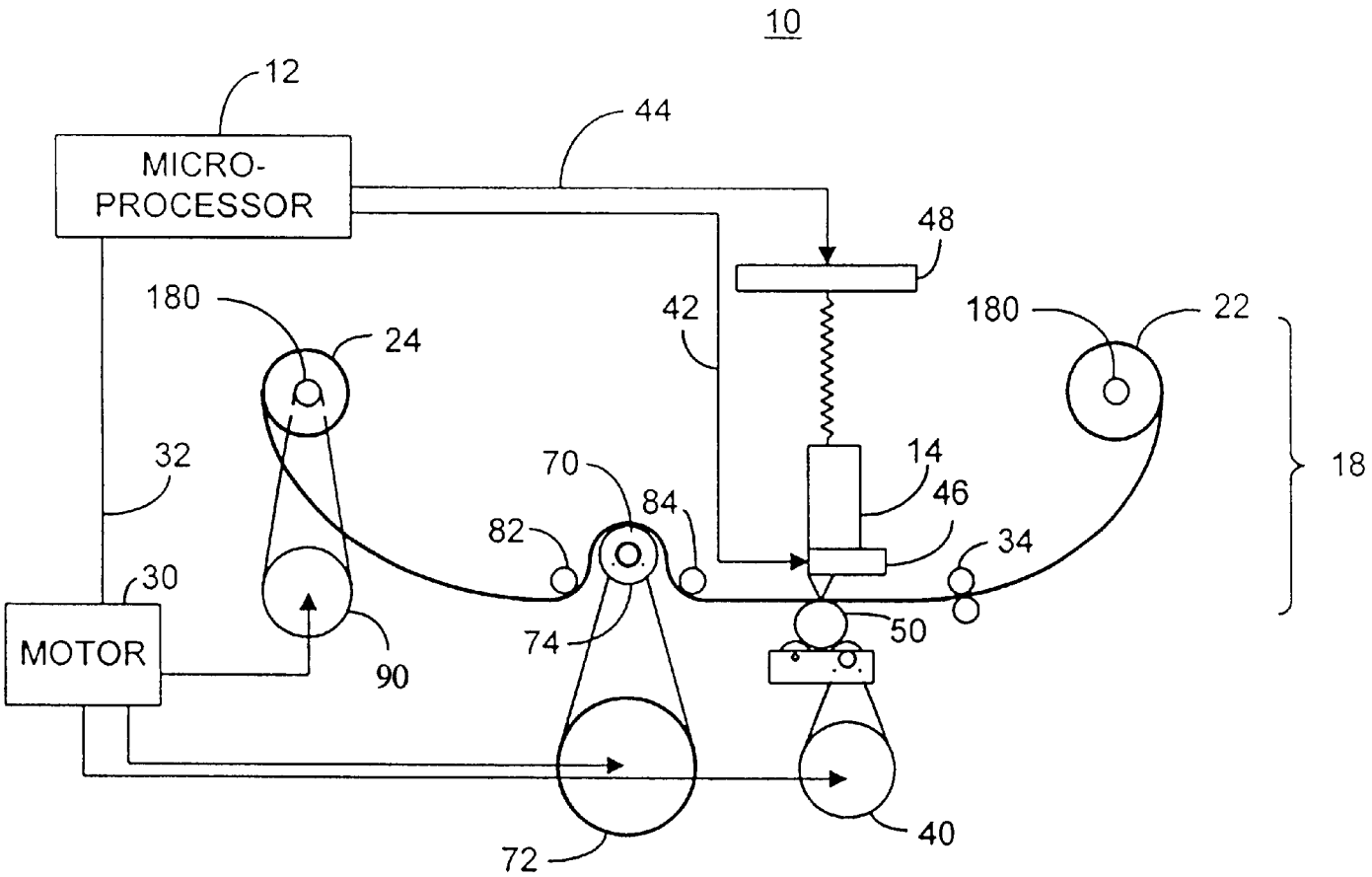
FIG. 2 depicts a partial diagrammatic side view of a cylinder print system having an alternative method for synchronously advancing a substrate with a print medium.

FIG. 2 depicts an alternative method of advancing thermal foil 20. This embodiment of the present invention employs a motor driven capstan roller 70, which drives thermal foil 20 through friction. Capstan roller 70 is controlled with an advancing mechanism 72, which is driven by motor 30. As described above, motor 30 receives control signals 80 from microprocessor 12. Advancing mechanism 72 uses a belt or gear system to drive capstan roller 70.

In this embodiment, thermal foil 20 is partially wrapped around an outer surface 74 of capstan roller 70 and is held against the outer surface 74 by a pair of guide rods 82, 84. As capstan roller 70 is advanced, friction between thermal foil 20 and the outer surface 74 advances thermal foil 20. Pull tension is determined by the amount of thermal foil 20 wrap on capstan roller 70. Guide rods 82, 84 may be adjusted to determine the amount wrap on capstan roller 70.

Slack created in thermal foil 20 between capstan roller 70 and take-up roll 24 is controlled by an advancing mechanism 90 connected to take-up roll 24. Advancing mechanism 90 is preferably driven by motor 30. Take-up roll 24 may further include a slip clutch (not shown) or other similar device so that take-up roll 24 may be overdriven with respect to the rate of advance of thermal foil 20. As described above, an optional advancing mechanism 40 for driving supporting roller 56 and rotating a cylindrical substrate 50 may be included in this embodiment as well. Otherwise, the friction between thermal foil 20 and substrate 50 may be all that is required to synchronously advance thermal foil 20 and substrate 50 with print head 46.

Figure 3:
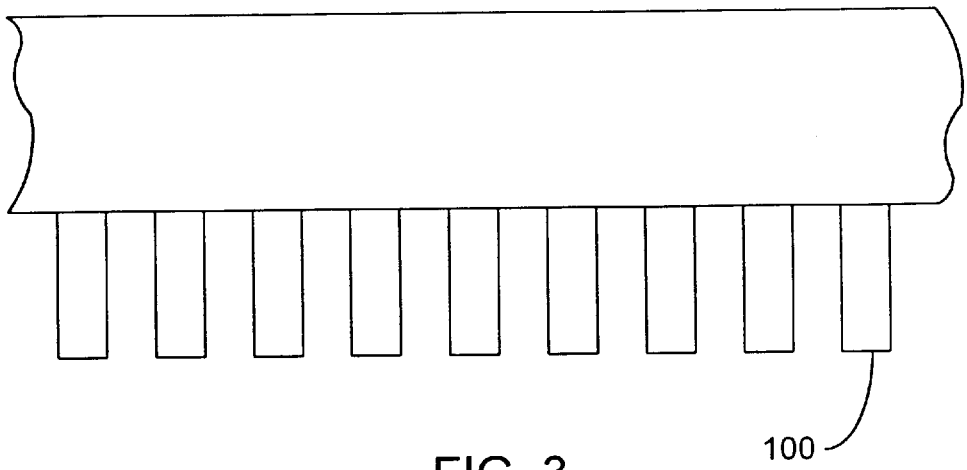
FIG. 3 depicts a partial diagrammatic front view of the thermal print head of FIG. 1.
Figure 4:
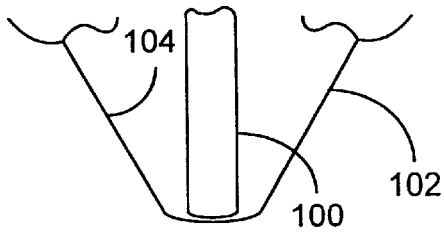
FIG. 4 depicts a magnified partial view of the thermal print head of FIG. 1.
Figure 5:
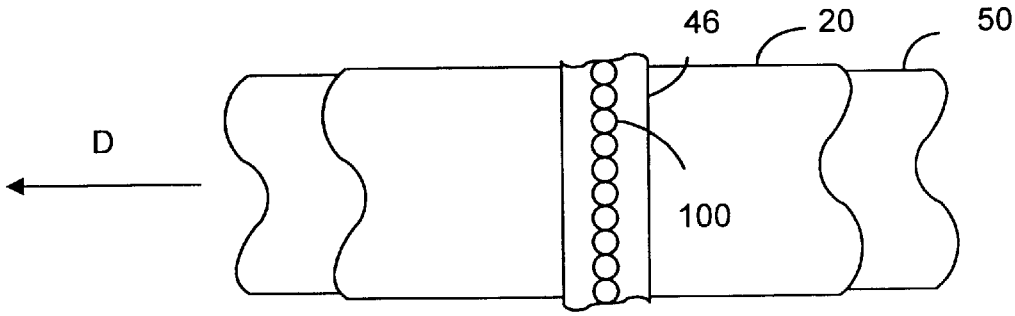
FIG. 5 depicts a magnified top view of a portion of the thermal print head of FIG. 1.

Referring to FIGS. 3 through 5 print head 46 is preferably a true edge, near edge, or convex type thermal print head that includes a plurality of spaced-apart linearly arranged heating elements 100. The heating elements 100 are shown arrayed perpendicularly to the direction of travel D of substrate 50 and thermal foil 20. Microprocessor 12 provides to print head 46 a plurality of control signals on line 42 that turn on (and off) certain of the individual heating elements 100 needed to produce a desired printed shape.

A print head glazing (cover) 102, preferably glass, covers the heating elements 100 and when the heating elements are turned on efficiently conveys heat from the heating elements 100 to thermal foil 20. When heating elements 100 are turned off, the heads ceramic substrate 104 efficiently dissipates the heat to avoid unwanted heat transfer. As substrate 50 is advanced beneath print head 46, the combination of heat and pressure conveyed from the selectively heated heating elements 100 and the pressure mechanism 48 to thermal foil 20 thermally alters the foil 20, thereby transferring a selected shape to substrate 50 in a line-by-line manner. It is important to note that in the above and below systems that substrate 50 and thermal foil 20 should be synchronously advanced with each print line (strobe) in order to prevent image artifacts caused by stretched images, misses or sticking.

Figure 6:
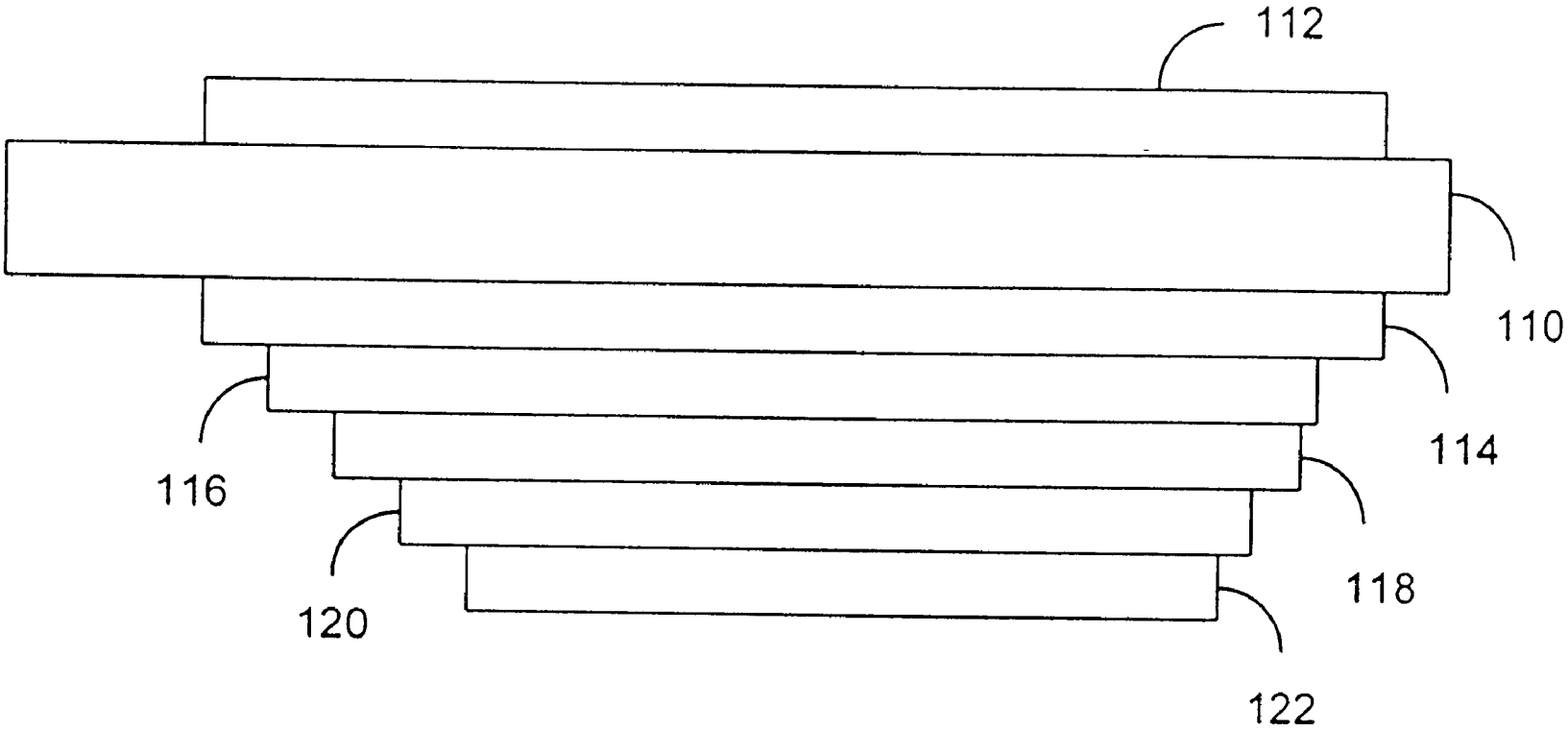
FIG. 6 depicts is a diagrammatic cross-sectional view of a thermal foil according to the present invention.

Referring now to FIG. 6, thermal foil 20 includes a film carrier 110, which preferably does not distort when subjected to the relatively high temperatures and pressures associated with digital thermal printing. The foil 20 further includes a thermally resistive backcoating 112 adhered to the surface of film carrier 110. Backcoating 112 includes a lubricant that reduces the drag of print head 40 as it passes over thermal foil 20, and further includes a filler material that smoothes the surface of film carrier 110. Backcoating 112 may also contain an anti-static agent, which reduces electrostatic discharge between thermal print head 40 and thermal foil 20.

By way of example, thermal foil 20 may include some or all of the following layers attached to film carrier 110; a thermally activated loose yet clean release coat 114 (which may contain wax and or resins), a high temperature top coat 116, an aluminum layer 118 (in metallized foils), a prep coat 120 and a fast-acting yet aggressive thermally activated sizing or adhesive 122.

The order in which the layers of thermal foil 20 are applied to film carrier 20 is important. For example, backcoating 112 requires heat curing, and it is thus important to apply the layer as early as possible to the film carrier 110 in the foil manufacturing process. Otherwise, the heat used to cure the backcoating 112 may change the properties of the other layers of thermal foil 20. The release coat 114 and the thermally activated sizing or adhesive 122 are particularly susceptible to heating and may make the thermal foil 20 flaky or loose.

Preferably, film carrier 20 has a gauge of less than 0.5 mil., but a thicker gauge film may be used. For example, a 0.3 mil. gauge film allows for improved heat transfer between print head 46 and thermal foil 20 and thus allows for quicker dwell times and increased print speeds from cylinder print system 10 than thicker gauge films. Additionally, a decrease in the gauge of film carrier 110 allows for cooler print head 46 temperatures because less heat is required to transfer an image from thermal foil 20 to a substrate. Furthermore, lower print head temperatures help protect thermal foil 20 from crazing.

Figure 7:
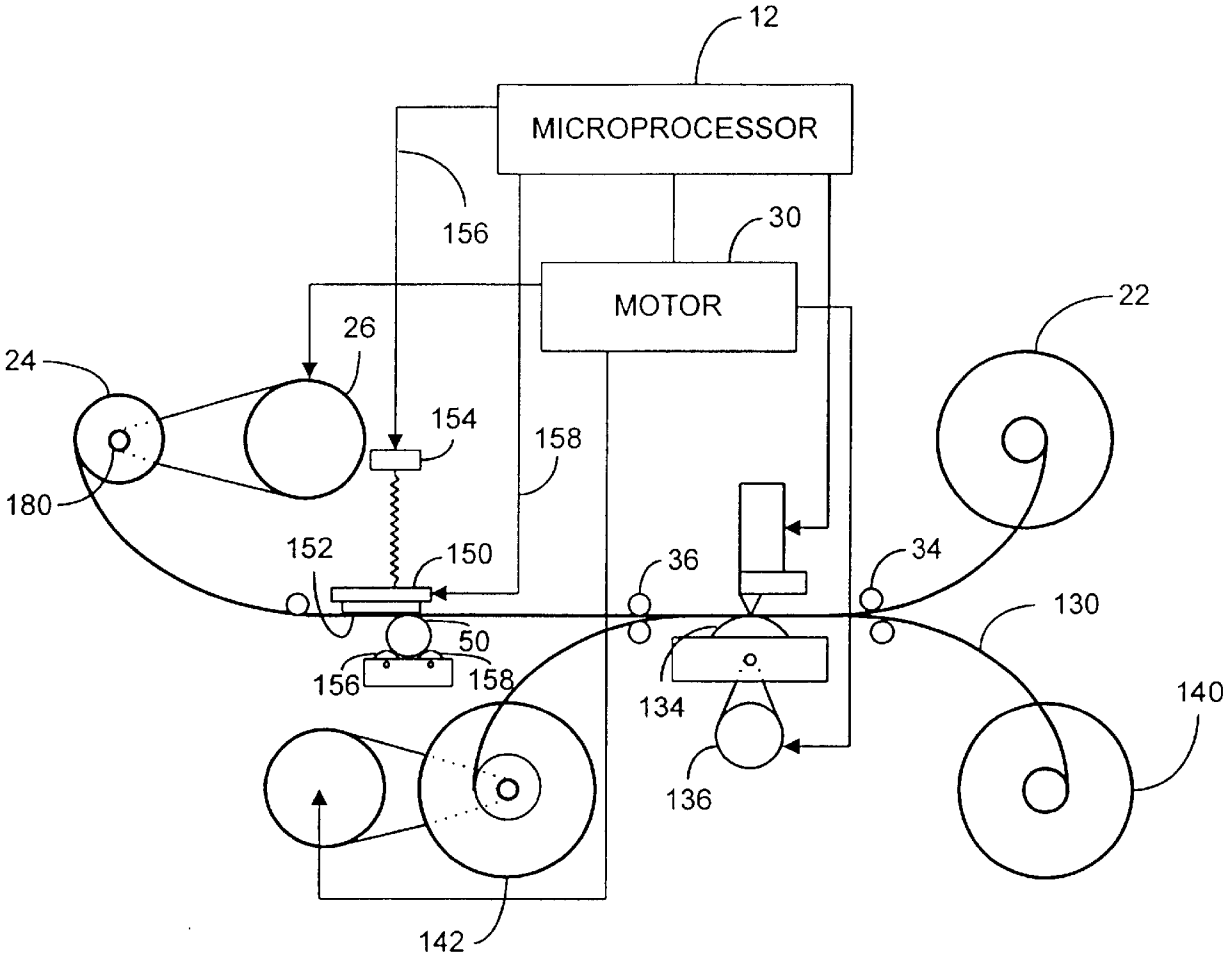
FIG. 7 depicts a partial diagrammatic side view of a cylinder print system that employs a two step print process.

FIG. 7 depicts an alternate method of transferring an image from thermal foil 20 to cylindrical substrate 50. This embodiment employs a two-step transfer process wherein an image is created on thermal foil 20 in a first step and wherein the image is transferred to substrate 50 in a second step. During the first printing step an image is produced by applying heat to thermal foil 20 using thermal print assembly 14, however, rather than printing an image directly onto substrate 50, a negative image is printed onto a throwaway medium 130 (e.g., film or paper) using a platen assembly 132, thereby leaving the image to be printed on substrate 50 remaining on thermal foil 20.

Platen assembly 132 includes a platen 134 and an optional advancing mechanism 136. Throwaway medium 130 is supplied from a supply roll 140 and collected on takeup roll 142 in much the same way that thermal foil 20 is supplied and collected. Throw-away medium 130 is preferably synchronously advanced with thermal foil 20 and platen 134. Platen 134 may be rotated similarly to that of substrate 50 in the above-described embodiments, using either friction from throwaway medium 130 or from advancing mechanism 136. In a first printing step the print head 46 selectively heats and transfers to throwaway medium 130 the portions of the foil that are not included in the image that is to be transferred to substrate 50. Accordingly, all of these portions that are not part of the image are printed on the throwaway medium.

In the second printing step, that part of thermal foil 20 retaining the image to be transferred is advanced until it is in contact with the surface of substrate 50. When the image portion of thermal foil 20 encounters the surface of substrate 50, the image is transferred to substrate 50 by a heated rubber stamp device 150. The heated rubber stamp device 150 is shown having a flat surface 152, however a curved or deformable surface may be employed, thereby facilitating the transfer of images to tapered or other nonperfectly cylindrical shaped substrates. A pressure mechanism 154 such as a pneumatic actuator device, which is controlled by signals 156 received from microprocessor 12, applies pressure to thermal foil 20 where thermal foil 20 contacts substrate 50. Similarly, the temperature of heated rubber stamp device 150 is controlled by signals 158 received from microprocessor 12.

A pair of supporting rollers 156, 158 supports substrate 50. An optional advancing mechanism (not shown) for driving one of the supporting rollers 156, 158 may also be employed for aiding in the rotation of cylindrical substrate 50 during the printing process. Although, in this embodiment, thermal foil 20 is shown being advanced by an advancing mechanism 160, a capstan type roller such as that described above (not shown) 5s or other advancing means may be used to synchronously advance thermal foil 20 with substrate 50.

Figure 8:
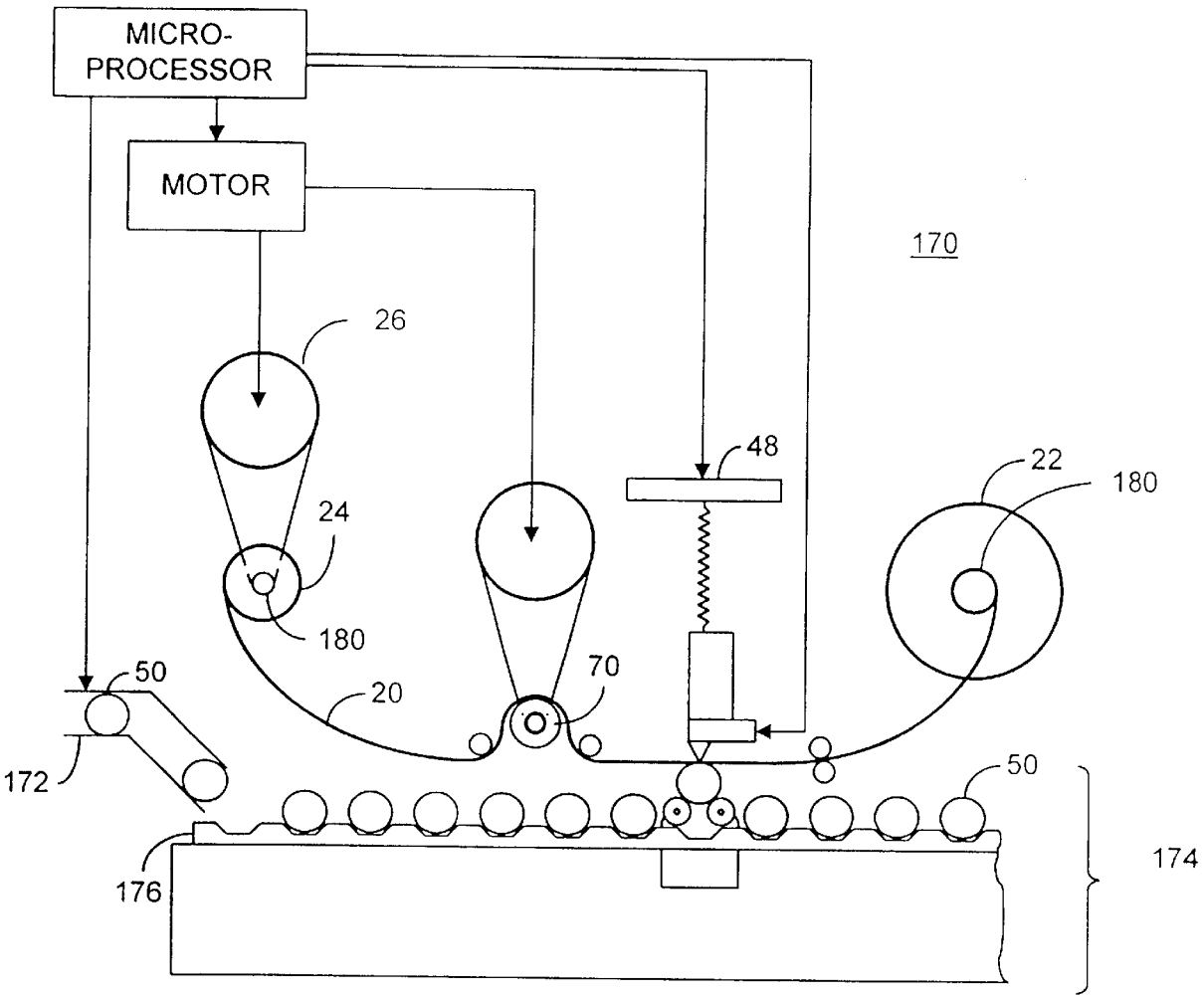
FIG. 8 depicts a partial diagrammatic side view of a cylinder print system having an automatic substrate feed system.

FIG. 8 depicts a cylinder print system 170 having a substrate feeding mechanism 172, which is capable of feeding a plurality of cylindrical substrates 50 to print system 170. Cylinder print system 170 includes a microprocessor 12, a thermal print head assembly 14, and a thermal foil assembly 18 in accordance with the above-described embodiments. Cylinder print system 170 further includes a substrate advancing system 174 comprising a conveyor mechanism 176 and a substrate positioning mechanism 178.

In the substrate feeding mechanism 172, a plurality of the substrates 50 are fed from a loader (not shown) onto conveyor mechanism 176, which must stop intermittently to accommodate the printing operation. During the conveyor dwell, the substrate 50 being printed is lifted out of the conveyor mechanism 176 by positioning the mechanism 178 so as to be contacted by the print head 46. The positioning mechanism 178 further comprises a pair or rollers 180, 182 upon which the substrate 50 is free to roll. Upon contact with the print head 46, the thermal foil 20 is advanced using a capstan roller 70 and an image generated by the microprocessor 12 is printed onto the substrate 50.

It should be noted that the substrate feeding mechanism 172 and the substrate advancing mechanism 174 are merely exemplary. It is contemplated that any known method of feeding and positioning a substrate may be used to deliver a plurality of substrates for printing. In addition, any of the above-described methods of advancing the thermal foil 20 or rotating the substrate 50 may be substituted for those methods depicted in FIG. 8.

Figure 9:
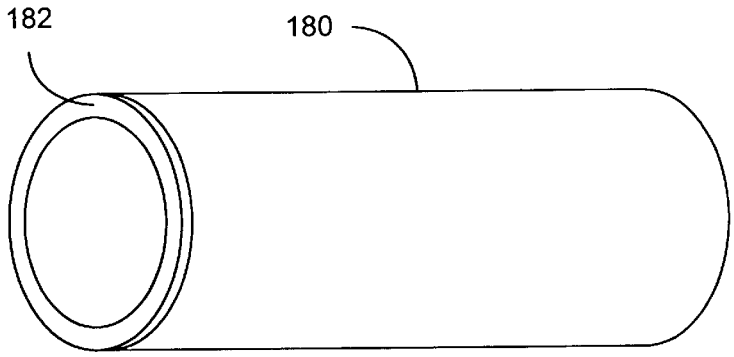
FIG. 9 depicts a perspective view of a foil core constructed in accordance with the invention.
Figure 10:
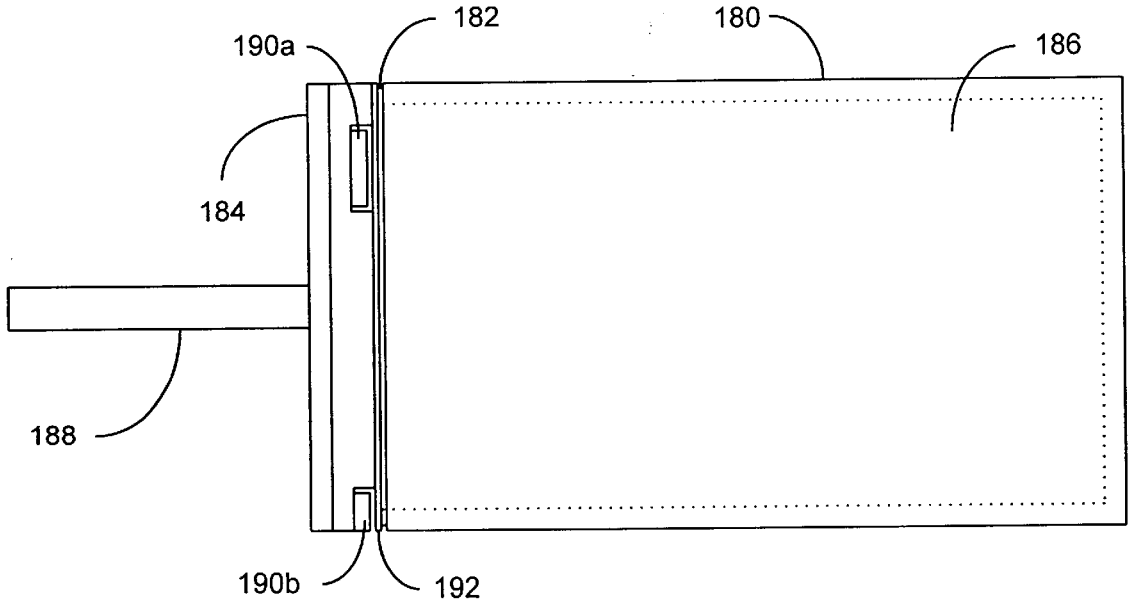
FIG. 10 depicts a mounting device for use with the foil core of FIG. 9.

Referring now to FIGS. 9–10, we discuss a method and apparatus for mounting the take-up roll 24 (FIG. 1) to the printing system. This technique, however, may also be used for mounting the supply roll 22 (FIG. 1). As shown in FIG. 9, a hollow thermal foil core 180, about which the thermal foil 20 (not shown) is wound, includes a ferrous ring 182 mounted on one end. A mounting device 184, for rotatably mounting the foil core 180, includes a core spindle 186 over which the thermal foil core 180 is slidably engaged. The mounting device 184 further includes a shaft 188 that is connected to and rotatably controlled by the printing system (i.e., by the advancing mechanism 26).

The thermal foil core 180 is slidably connected to the mounting device 184 using a series of magnets 190*a*, 190*b* that are preferably covered by a smooth cover 192 (e.g. plastic). The magnets, 190*a*, 190*b*, which may be a series of magnets or an individual magnet (e.g., a magnetic ring), releasably adhere to the ferrous ring 182. As the shaft 188 is rotated, the thermal foil core 180 will rotate in unison with the mounting device 184 until the tension in the thermal foil 20 exceeds the magnetic force between the magnets 190*a*, 190*b* and the ferrous ring 182, which will cause the foil core 180 to slip and stop rotating with respect to the mounting device 184.

This method of attaching the foil core 180 to the mounting device 184 allows the mounting device 184 to be overdriven without damage to the thermal foil 20. By way of example, if the thermal foil 20 is advanced through the printing system by the capstan roller 70 (FIG. 2), the tension in the thermal foil 20 between the capstan roller 70 and the take-up roll 24 will be temporarily reduced. If the tension in the thermal foil 20 is reduced to the point where the magnetic force between the magnets 190*a*, 190*b* and the ferrous ring 182 again exceeds the tension in the thermal foil 20, the overdriven mounting device 184 will cause the foil core 180 to rotate, collecting the slack in the thermal foil 20. Once the slack in the thermal foil 20 is collected, the tension in the thermal foil 20 will once again increase until the tension exceeds the magnetic force between the magnets 190*a*, 190*b* and the ferrous ring 182, which will cause the foil core 180 to slip with respect to the mounting device 184. The amount of tension in the thermal foil 20 that will cause the foil core 180 to slip can be adjusted by varying the strength of the magnets 190*a*, 190*b*.

As previously discussed, this method of attaching a foil core may also be used simultaneously with or exclusively for mounting the supply roll 22. In this embodiment, the magnetic force between the magnets 190*a*, 190*b* and the ferrous ring 182 acts as a breaking mechanism for the supply roll 22. For example, when the thermal foil 20 is advanced through the printing system by any of the above-described methods, the tension in the thermal foil 20 between the advancing mechanism and the supply roll 22 will increase. When this tension exceeds the magnetic force between the magnets 190*a*, 190*b* and the ferrous ring 182, in this case restraining supply roll 22, an amount of thermal foil 20 will be played out.

Additionally, this method of mounting thermal foil core 180 allows the supply of thermal foil 20 to be easily changed or replaced as thermal core 180 can be slipped off core spindle 186 without difficulty and a new supply of thermal foil can be mounted in its place. Also, other similar core mounting systems are contemplated wherein a magnetic force is created by magnets that are part of the core itself and which would adhere to a ferrous mounting device.

The foregoing has been a detailed description of preferred embodiments of the invention. Various modifications and additions can be made without departing from the spirit and scope of the invention.

What is claimed is:

1. A print system for printing an image onto the curved exterior surface of a non-flat substrate comprising:

a digital print engine having a contact surface;

a thermal foil, the thermal foil operatively positioned between the contact surface of the digital print engine and the curved exterior surface of the non-flat substrate;

a pressure mechanism for applying pressure between the contact surface of the digital print engine and the curved exterior surface of the non-flat substrate; and means for rotating the curved exterior surface of the non-flat substrate with respect to the contact surface of the digital print engine during printing, the means rotating the exterior surface in synchronism with the advancing of the thermal foil.

2. The system as set forth in claim 1 wherein the digital print engine selectively generates heat to one or more of a plurality of individually heatable heating elements and wherein the heating elements are operatively positioned to transmit heat to different portions of the contact surface.

3. The system as set forth in claim 2 wherein the means for rotating rotates the non-flat substrate also in synchronism with the timing of the controlling of the selective heating of the heating elements.

4. The system as set forth in claim 1 further comprising a microprocessor.

5. The system as set forth in claim 4 wherein the microprocessor is operatively connected to the digital print engine for selectively controlling one or more of the heating elements.

6. The system as set forth in claim 4 wherein the microprocessor is operatively connected to the pressure mechanism such that the microprocessor controls the relative pressure between the contact surface of the digital print engine and the surface of the substrate.

7. The system as set forth in claim 4 wherein the means for rotating the exterior surface of the non-flat substrate with respect to the contact surface of the digital print engine during printing is controlled by the microprocessor.

8. The system as set forth in claim 1 wherein the means for rotating the exterior surface of the non-flat substrate with respect to the contact surface of the digital print engine during printing includes advancing the thermal foil such that a frictional force between the thermal foil and the substrate rotates the substrate.

9. The system as set forth in claim 8 wherein the thermal foil is advanced using an overdriven motor and a slip clutch.

10. The system as set forth in claim 1 further comprising a pair of cylindrical support rollers for rotationally supporting the non-flat substrate.

11. The system as set forth in claim 10 wherein the means for rotating the exterior surface of the non-flat substrate with respect to the contact surface of the digital print engine during printing includes driving one of the cylindrical support rollers.

12. The system as set forth in claim 1 wherein the means for rotating the exterior surface of the non-flat substrate with respect to the contact surface of the digital print engine during printing includes driving one of a pair if cylindrical support rollers that rotationally support the non-flat substrate.

13. The system as set forth in claim 1 wherein the thermal foil is advanced using a capstan mechanism around which the thermal foil is partially wrapped.

14. The system as set forth in claim 1 wherein the image is a selected shape that is personalized.

15. The system as set forth in claim 1 wherein the image is a selected shape that is serialized.

16. The system as set forth in claim 1 wherein the digital print engine further comprises a thermal print head.

17. The system as set forth in claim 1 wherein the digital print engine further comprises a laser based print head.

18. A print system for printing an image onto the curved exterior surface of a cylindrical substrate comprising:

a digital print engine for selectively generating heat to one or more of a plurality of individually heatable heating elements;

a contact surface operatively positioned with respect to the heating elements such that heat can be transferred through the contact surface;

a thermal foil, the thermal foil operatively positioned between the contact surface of the digital print engine and the curved exterior surface of the substrate;

a pressure mechanism for applying pressure between the contact surface of the digital print engine and the exterior surface of the substrate;

a microprocessor operatively connected to the digital print engine for selectively controlling one or more of the heating elements; and means for rotating the cylindrical substrate with respect to the contact surface of the digital print engine during printing on the curved exterior surface, the means rotating the substrate in synchronism with the timing of the controlling of the selective heating of the heating elements.

19. The system as set forth in claim 18 further comprising a pair of cylindrical support rollers for rotationally supporting the cylindrical substrate.

20. The system as set forth in claim 18 wherein the means for rotating the exterior surface of the cylindrical substrate with respect to the contact surface of the digital print engine during printing includes driving one of a pair of cylindrical support rollers that rotationally support the non-flat substrate.

21. The system as set forth in claim 18 wherein the means for rotating rotates the non-flat substrate also in synchronism with the timing of the controlling of the selective heating of the heating elements.

22. A print system for printing an image onto the curved exterior surface of a cylindrical substrate comprising:

a digital print engine for selectively generating heat to one or more of a plurality of individually heatable heating elements;

a contact surface operatively positioned with respect to the heating elements such that heat can be transferred through the contact surface;

a platen roller;

means for rotating the platen roller with respect to the contact surface of the digital print engine during printing;

a thermal foil, the thermal foil operatively positioned between the contact surface of the digital print engine and the platen roller;

a throwaway medium, the throwaway medium operatively positioned between the thermal foil and the platen roller;

a pressure mechanism for applying pressure between the contact surface of the digital print engine and the platen roller;

a microprocessor operatively connected to the digital print engine for selectively controlling one or more of the heating elements;

a heatable stamping device, wherein the thermal foil is operatively positioned between the heatable stamping device and the curved exterior surface of the cylindrical substrate;

means for rotating the cylindrical substrate with respect to the heatable stamping device during printing on the curved exterior surface of the cylindrical substrate, the means rotating the cylindrical substrate in synchronism with the advancing of the thermal foil.

23. A method for transferring a selected shape onto the curved exterior surface of a cylindrical substrate, comprising the steps of:

providing a thermal foil;

bringing the curved exterior surface of the cylindrical substrate into contact with a first surface of the thermal foil;

applying heat and pressure to a second surface of the thermal foil using a digital print engine to cause a selected portion of the thermal foil to adhere to the curved exterior surface of the cylindrical substrate in a specific pattern; and rotating the cylindrical substrate with respect to the digital print engine and in synchronism with the advancing of the thermal foil during printing on the curved exterior surface of the cylindrical substrate.

24. The method of claim 23 wherein the step of rotating further includes rotating the essentially non-deformable cylindrical substrate in synchronism with a strobing of heating elements of the digital print engine.

* * * * *